US006638430B2

(12) United States Patent
Bratten

(10) Patent No.: US 6,638,430 B2
(45) Date of Patent: Oct. 28, 2003

(54) MAGNETIC SEPARATOR AND PROCESS FOR REMOVING FERROMAGNETIC PARTICLES FROM A LIQUID

(76) Inventor: Jack R. Bratten, 4657 Twin Fawn La., Orchard Lake, MI (US) 48324

( * ) Notice: Subject to any disclaimer, the term of this patent is extended or adjusted under 35 U.S.C. 154(b) by 84 days.

(21) Appl. No.: 09/853,886

(22) Filed: May 11, 2001

(65) Prior Publication Data

US 2001/0052498 A1 Dec. 20, 2001

Related U.S. Application Data

(60) Provisional application No. 60/203,728, filed on May 12, 2000.

(51) Int. Cl.[7] ..... B03C 1/00; B03C 1/02

(52) U.S. Cl. ..... 210/695; 210/391; 210/222; 209/226

(58) Field of Search ..... 210/222, 695, 210/223, 324, 400, 391, 526, 396, 416.1, 209; 209/213, 636, 226

(56) References Cited

U.S. PATENT DOCUMENTS

| | | | | |
|---|---|---|---|---|
| 3,834,542 A | * | 9/1974 | Linstruth | 198/619 |
| 4,031,011 A | * | 6/1977 | Dorgathen | 210/222 |
| 4,039,447 A | * | 8/1977 | Miura et al. | 210/223 |
| 5,938,935 A | * | 8/1999 | Schimion | 210/222 |

* cited by examiner

*Primary Examiner*—Joseph Drodge
*Assistant Examiner*—Krishnan S Menon
(74) *Attorney, Agent, or Firm*—John R. Benefiel

(57) ABSTRACT

A magnetic separator and process involving a train of parallel, spaced magnetic bars connected together to form a closed loop disposed in a tank able to receive a liquid containing ferromagnetic particles which are to be removed from the liquid. The liquid is introduced by an inlet extending within the closed loop so that the liquid is constrained to flow out through spaces between the magnetic bars. Flow out of the tank is through perforate distributor plates and over a pair of weirs, the perforate plates and weirs extending along a respective side of the closed loop to distribute the flow through all of the bar spaces.

10 Claims, 4 Drawing Sheets

MAGNETIC SEPARATOR AND PROCESS FOR REMOVING FERROMAGNETIC PARTICLES FROM A LIQUID

CROSS REFERENCE TO RELATED PATENT APPLICATION

This application claims the benefit of U.S. provisional application Ser. No. 60/203,728, filed on May 12, 2000.

BACKGROUND OF THE INVENTION

The invention concerns magnetic separators used to remove ferromagnetic particles from a liquid, as used in conjunction with removal of contaminants machining fluids so as to allow its reuse. In the large scale production of machined metal parts, such as automotive engine components machining, fluid used to cool and lubricate the cutting tools is collected and purified and recirculated for reuse, filters are used to purify the fluid.

It is sometimes desirable to separately remove the metal particles, as for example the fines produced when grinding a part, as to avoid clogging of the filter media.

Magnetic separators have heretofore been developed for this purpose and have been commercially available for a number of years.

These prior separators include a closely spaced train of elongate magnetic bars comprised of nonmagnetic tubes filled with short magnetic cylinders, and the fluid is caused to flow between the spaces between the bars, the steel or iron particles attracted to the surfaces of the bars and held thereto to be removed from suspension in the liquid. The train of bars supported on chain loops is driven to bring each pair of bars in to a scraping station where the accumulated particles are scraped off and deposited in a discharge chute.

Such a device is shown in U.S. Pat. Nos. 4,031,011; 4,261,826; and 4,209,403.

In the device of the type shown in these patents, the bars are mounted to chain arranged in a closed loop partially disposed in a tank, which loop is advanced to bring each bar into the scraping station. The fluid is introduced into the tank space outside the loop of magnetic bars and flows into the space within the loop by flowing through the spaces between the bars. The spacing and flow rates are set to produce a sufficiently low flow velocity so that the particles can migrate to the bars.

Since the flow is from outside the loop into the space within the loop, some of the metal particles are able settle to the tank bottom before entering the spaces between the bars, such particles accumulating in the tank to require clean out of the tank at frequent intervals.

Distributor plates are provided to insure relatively even flows through all of the pairs of adjacent bars, but these are of necessity located within the loop, requiring disassembly of the chain loops to remove the plates for cleaning.

These devices also have a complex mechanism for driving the loop and the scraper mechanism, and the scraper mechanism itself is subject to misalignments.

In copending allowed patent application Ser. No. 09/502,145, filed Feb. 11, 2000, now U.S. Pat. No. 6,277,276, issued Aug. 21, 2001 here incorporated by reference, an improved scraper mechanism is described and claimed for the bars of a magnetic separator.

It is the object of the present invention to provide an improved magnetic separator of the type described in which all metal particles must pass by the magnetic bars so as to avoid settling out of these particles to the tank bottom.

SUMMARY OF THE INVENTION

The above object and others which will become apparent upon a reading of the following specification and claims are achieved by directing the inlet flow into a closed space within the loop of bar magnets and inducing flow radially outwardly through the spaces between the bars. This insures that all particles must pass through bar spaces and cannot settle out to the tank bottom prior to being subjected to the strong magnetic field between the bars.

The distributor plates are located outside the bar loop so as to be easily removable for cleaning.

DETAILED DESCRIPTION

Figure 1:
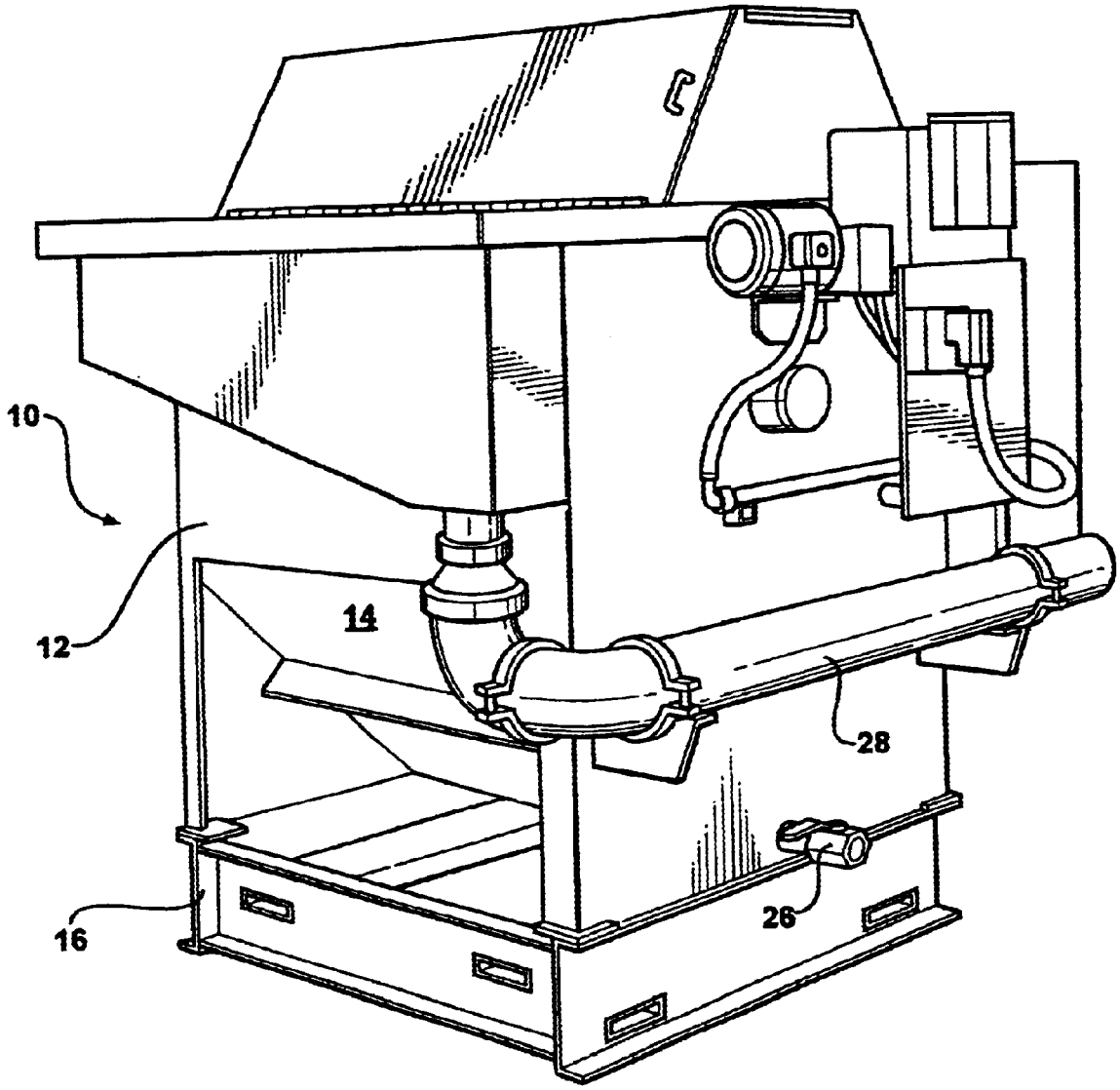
FIG. 1 is a perspective external view of a magnetic separator according to the invention.
Figure 2:
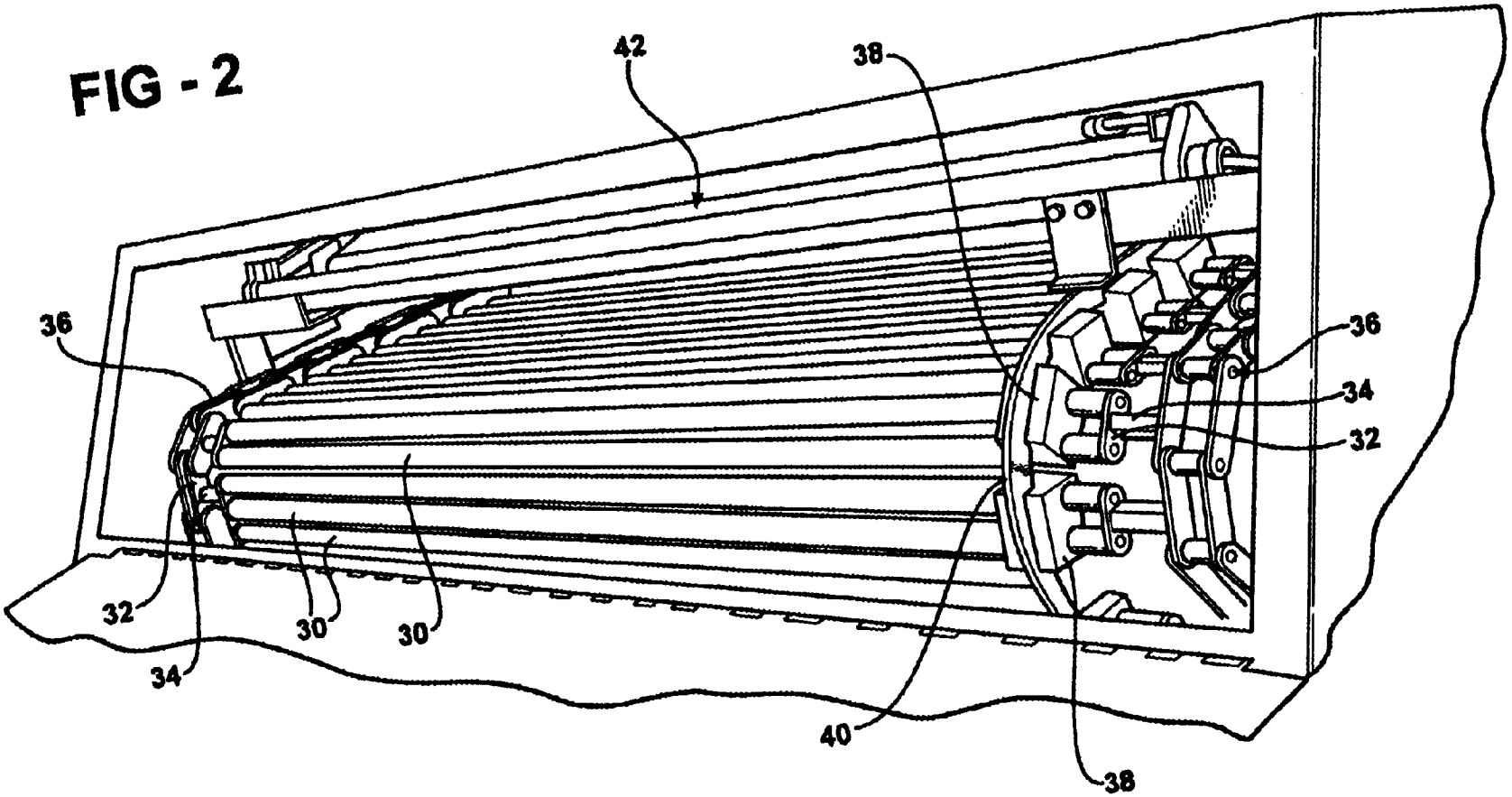
FIG. 2 is an enlarged fragmentary perspective view of a portion of the magnetic separator shown in FIG. 1 with a cover removed to show internal details.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings, the magnetic separator 10 according to the invention includes a welded plate tank 12 having sloping bottom walls 14, the tank 12 resting on a base 16. A pair of sloped bottom weir flow collector vessels 18, 20 are located on either side of the tank 12, which receive outflow of clean liquid over weirs, described below, a discharge fitting 22, 24 is located at the low end of each weir flow collector vessel 18, 20, both connected to a return pipe 28 as shown.

A flush drain valve 26 is located at the bottom of the tank 12, and a clean out opening also provided.

A close looped train of parallel, side by side elongated magnetic bars 30 is supported to be recirculated within the interior of the tank 12. The magnetic bars 30 are of a commercially available type, constructed of stainless steel tubes having ceramic discs stacked therein up to a point several inches from each end. The nonmagnetic stainless steel is able to be periodically scraped to remove accumulated particles. The bars 30 are relatively closely spaced, i.e., ½" or so apart, the flow velocity between the bars thereby limited to a few cm/sec to allow the particles to migrate to the surfaces of the bars 30 where they are held as the liquid passes between the bars 30.

The bars 30 are connected in pairs on end pieces 32 welded to support bars 34 in turn welded to respective links of chain loops 36 at either end of the bars 30. The chain loop 36 are supported on guides (not shown), which also tend to restrict flow around the bars 30.

Plastic scraper blocks 38 are permanently mounted on each adjacent pair of bars 30, positioned by a fixed guide band 40 engaging an outer slot on each of the aligned scraper blocks 38.

A rodless cylinder 42 is mounted above the top of the bar loop and, as described in detail in the copending application incorporated by reference above, each block 40 is successively engaged to be stroked down and back on the respective pair of bars 30, to clean off accumulated particles.

Figure 5:
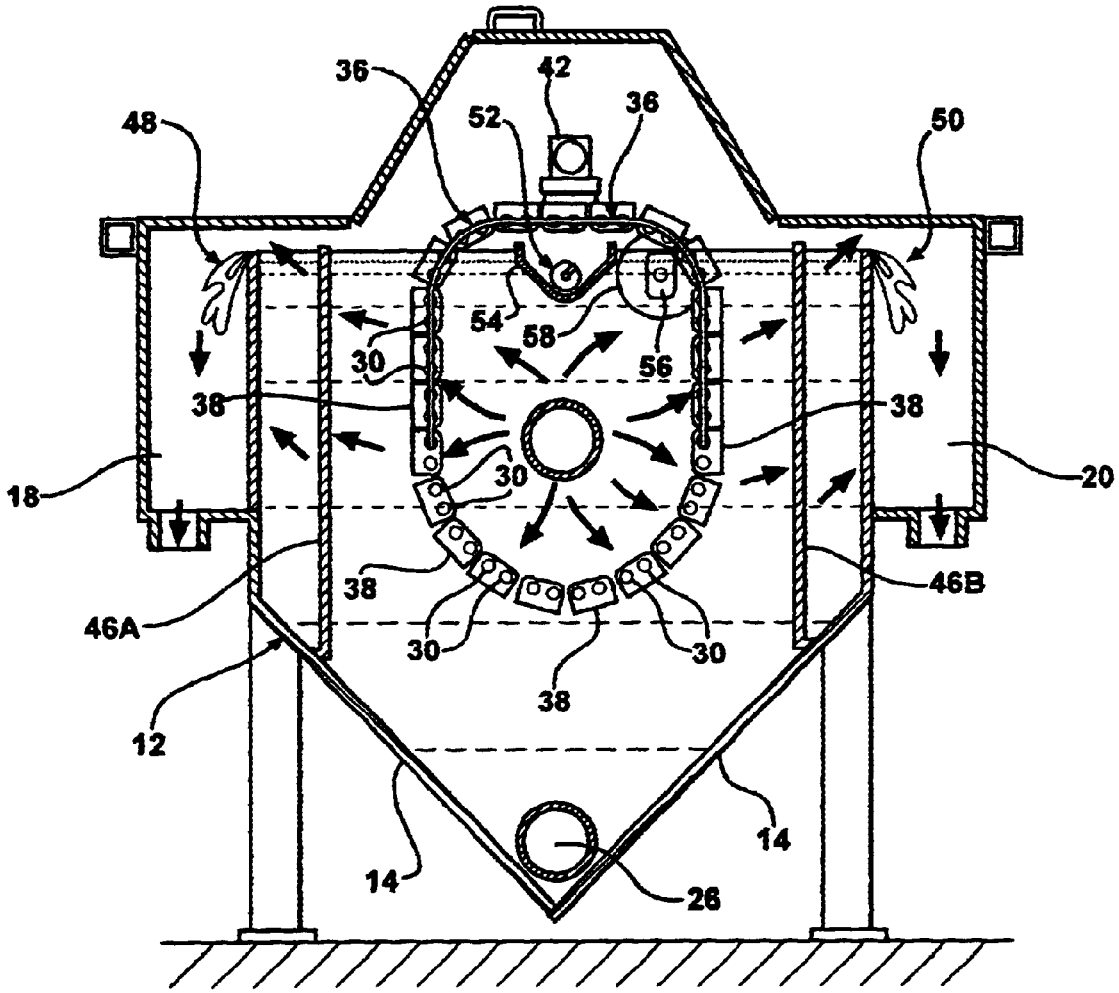
FIG. 5 is a diagrammatic representation of the basic arrangement of the magnetic separator according to the invention.

As best seen in FIG. 5, a slotted inlet pipe 44 extends in from one end of the tank 12 to introduce liquid to be treated centrally within a closed spaced defined by the closed loop train of magnetic bars 30. A distributed flow of liquid into the tank 12 occurs along the slots 43 in the inlet pipe 44 which liquid is constrained to flow radially out and pass between the spaces between adjacent pair of magnetic bars 30.

The closed loop of bars 30 is centrally located in the tank 12 so that a space between each tank sidewalls and the loop exist.

A pair of perforated distributor plates 46A, 46B distributes outflow along either side of the tank 12 to insure more uniform flow between all of the bars 30 to a pair of weirs 48, 50, each located on one side of the loop of bars 30. A slight pressure drop, i.e., 1 psi is established across the plates 46A, 46B to insure distributed flow across the entire area of the plates 46A, 46B. Weirs 48, 50 set the level of liquid in the tank causing immersing all but those bars 30 passing back across the top of the liquid. The weirs 48, 50 also distribute the outflow lengthwise along the length of the bars 30.

Figure 4:
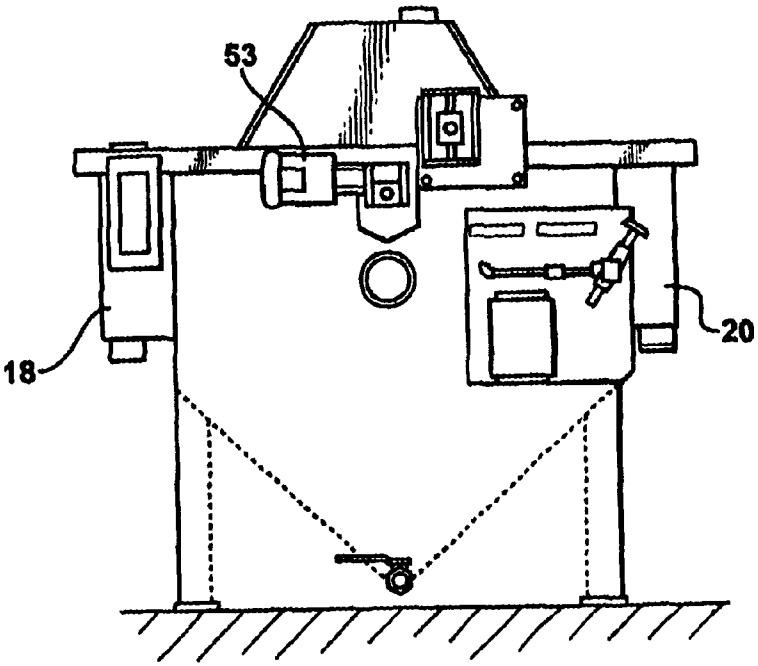
FIG. 4 is a front end view of the separator shown in FIG. 1.
Figure 3:
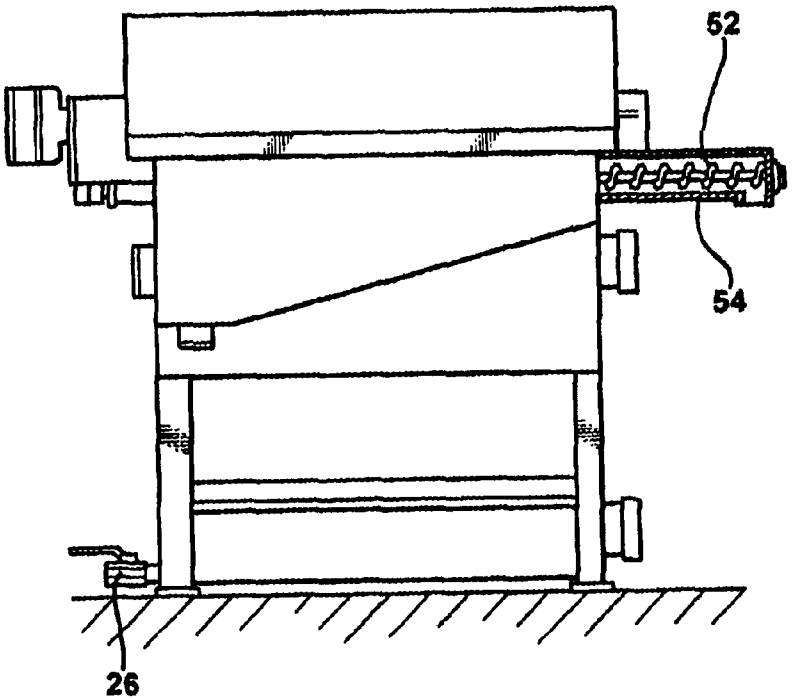
FIG. 3 is a side view of the separator shown in FIG. 1.

An auger conveyor 52 driven by an electric drive 53 (FIG. 4) is provided extending beneath the bars 30 at the scraping station, nested within a chute 54 projecting out one end of the separator 10 (FIG. 3).

A rotary air actuator 56 is utilized to periodically index the chain loops 36 by a sprocket 58 to bring the next pair of bars 30 to be scraped into the scraping station.

The introduction of the liquid to be cleaned from within the magnetic bar loop insures that all of the particles will pass between the bars and thus maximize the extent of their removal from the liquid. Furthermore, any large items accidentally dropped in the liquid, i.e., gloves, etc. will tend to be carried up out of the liquid and dumped into the chute 54.

What is claimed is:

1. A magnetic separator for removing ferromagnetic particles suspended in a liquid, said separator comprising a tank adapted to contain a liquid;

a train of spaced apart elongated magnetic bars connected together and arranged within said tank in a closed loop of bars defining a closed space within;

a loop drive advancing said loop of bars in a recirculating path around said space within said tank;

an inlet directing liquid into said closed space in said tank within said loop of magnetic bars; and, at least one outlet located outside said loop of bars for drawing liquid out of said tank after passing radially out of said closed space through spaces between said bars on each side of said inlet;

an intervening space between said loop of magnetic bars and a tank sidewall on each side of said loop, and a perforated distributor disposed in each intervening space extending vertically down each side of said loop of bars to distribute flow into said spaced apart bars to said at least one outlet.

2. The separator according to claim 1 wherein a pair of outlets are provided, each communicating with a respective tank space located on a respective side of said loop of magnetic bars.

3. The separator according to claim 1 wherein said at least one outlet include a weir extending along each side of said loop at a predetermined level in said tank to maintain said liquid in said tank at said predetermined level.

4. The separator according to claim 2 wherein each perforated distributor comprises a perforated plate positioned in each intervening space causing distributed flow out through the spaces to a respective outlet between said bars.

5. The separator according to claim 1 wherein said inlet comprises a pipe extending across said tank and within said loop of magnetic bars, said pipe having openings along the length thereof to distribute flow out of said pipe and into said tank along the length of said pipe.

6. A process for removing ferromagnetic particles from a liquid comprising the steps of:

providing a tank for containing said liquid;

providing a train of spaced apart connected magnetic bars arranged in a closed loop suspended to define a closed space within said tank;

introducing liquid containing said ferromagnetic particles into said tank through an inlet extending into said closed space within said closed loop of magnetic bars; and inducing a radial outflow of liquid out of said closed space and through spaces between said bars on each side of said inlet and out of said tank through at least one tank outlet located outside said closed space defined by said closed loop of magnetic bars.

7. The process according to claim 6 wherein in said step of introducing said liquid into said tank, said flow is introduced through an elongated slotted pipe extending within said loop of connected magnetic bars to distributed flow along the length of said bars.

8. The process according to claim 6 wherein in said step of inducing flow out of said tank, outflow of said liquid is directed over at least one weir extending alongside said magnetic bars.

9. The process according to claim 8 wherein in said inducing step, outflow is directed over a weir extending alongside said magnetic bars on each side of said closed loop.

10. The process according to claim 6 wherein said step of inducing flow out of said tank includes the step of distributing flow between all of the spaces between said magnetic bars immersed in said liquid by positioning in said tank a distribution plate having openings therein adjacent each side of said closed loop so as to intercept outflow from said tank to thereby distribute flow through substantially all of the spaces between said magnetic bars immersed in said liquid.

* * * * *